US009497839B2

(12) United States Patent
Striker et al.

(10) Patent No.: US 9,497,839 B2
(45) Date of Patent: Nov. 15, 2016

(54) BOOSTING/BLANKING THE FILAMENT CURRENT OF AN X-RAY TUBE

(75) Inventors: Timothy Striker, Hamburg (DE); Thomas Lehmann, Hamburg (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 272 days.

(21) Appl. No.: 13/384,870

(22) PCT Filed: Aug. 26, 2010

(86) PCT No.: PCT/IB2010/053837

§ 371 (c)(1), (2), (4) Date: Jan. 19, 2012

(87) PCT Pub. No.: WO2011/024136

PCT Pub. Date: Mar. 3, 2011

(65) Prior Publication Data

US 2012/0163546 A1 Jun. 28, 2012

(30) Foreign Application Priority Data

Aug. 31, 2009 (EP) ..... 09169005

(51) Int. Cl.

| | |
|---|---|
| ***H05G 1/00*** | (2006.01) |
| ***H05G 1/34*** | (2006.01) |
| ***H05G 1/46*** | (2006.01) |
| ***H05G 1/56*** | (2006.01) |
| ***H05G 1/58*** | (2006.01) |

(52) U.S. Cl.

CPC ..... *H05G 1/34* (2013.01); *H05G 1/46* (2013.01); *H05G 1/56* (2013.01); *H05G 1/58* (2013.01)

(58) Field of Classification Search

CPC ..... H05G 1/265; H05G 1/34; H05G 1/46; H05G 1/08; H05G 1/26–1/58

See application file for complete search history.

(56) References Cited

U.S. PATENT DOCUMENTS

| | | | | |
|---|---|---|---|---|
| 4,775,992 | A | 10/1988 | Resnick et al. | |
| 5,077,772 | A | 12/1991 | Sammon et al. | |
| 5,546,441 | A * | 8/1996 | Stege | 378/110 |
| 7,016,468 | B1 | 3/2006 | Krema et al. | |

(Continued)

FOREIGN PATENT DOCUMENTS

| | | | |
|---|---|---|---|
| CN | 1461144 | A | 12/2003 |
| DE | 102005062839 | A1 | 7/2006 |

(Continued)

*Primary Examiner* — David J Makiya
*Assistant Examiner* — Dani Fox

(57) ABSTRACT

For boosting/blanking the filament current of a cathode of an X-ray tube the temporal variation of the tube current of the X-ray tube is measured and stored in a first memory. Then an iterative boosting/blanking is performed wherein the boosting/blanking current is applied to the filament for a short time interval (Δt), based on the stored temporal variation of the tube current the tube current after the short time interval (ΔT) is determined, and the tube current is stored in a second memory. Based on the stored temporal variation of the tube current it is determined if the tube current (IE) is less than a target value (IE2) thereof, and if so, the boosting/blanking current is applied to the filament for an additional time interval (Δt), else it is determined that the tube current (IE) is equal to the target value (IE2). Therefore, the tube current (IE) after each time interval (Δt) is known (may be determined from the tube current data stored in the second memory)such that the iterative boosting/blanking may be interrupted anytime.

21 Claims, 2 Drawing Sheets

(56) References Cited

U.S. PATENT DOCUMENTS

| | | | | |
|---|---|---|---|---|
| 7,366,283 | B2 * | 4/2008 | Carlson et al. | 378/108 |
| 2003/0219100 | A1 | 11/2003 | Okoda | |
| 2004/0264643 | A1 | 12/2004 | Chretien | |

FOREIGN PATENT DOCUMENTS

| | | | |
|---|---|---|---|
| EP | 0682466 | A1 | 11/1995 |
| JP | H09313470 | A | 12/1997 |
| JP | H2712311 | B2 | 2/1998 |

* cited by examiner

BOOSTING/BLANKING THE FILAMENT CURRENT OF AN X-RAY TUBE

FIELD OF THE INVENTION

The invention relates to X-ray systems, and more specifically to an X-ray tube.

BACKGROUND OF THE INVENTION

Reference U.S. Pat. No. 5,546,441 relates to an X-ray system including an X-ray generator for operating an X-ray tube having a cathode which can be heated by the filament current, comprising means which are operated in an exposure mode for boosting the filament current to a boost value for the duration of a boost time, and means operated in the exposure mode to decrease the filament current and to switch on the tube voltage. The X-ray generator has a special mode in which the filament current is boosted to the boost value while the tube voltage is switched on, means are provided for measuring the tube current flowing in the special mode, a first memory is provided for storing the temporal variation of the measured tube current, and means are provided for deriving a boost time from the temporal variation stored in the first memory. A second memory may be provided in which stationary values of the filament current are stored for various tube voltages and tube currents, and the means for deriving the boost time performs an access to the first memory and the second memory.

SUMMARY OF THE INVENTION

The X-ray generator described in the reference provides a boost time which, after it has been determined as mentioned above, is fixed such that the boost current is applied for the entire duration of the boost time.

It would be advantageous if the boost time could be interrupted, and then an immediate switch-over to a new boost time required to provide a new tube current could be performed. However, when a boost time is interrupted, the tube current (or the filament temperature, i.e. the filament current) at the point of time when be interruption occurred is not known.

In other words, it would be advantageous if the reaction time of the X-ray tube, when switching from a previous tube current value to a new tube current value is performed, could be shortened.

The invention is based on the above-mentioned recognition.

The object of the invention is shortening the reaction time of an X-ray tube.

The invention is defined in the independent claims. Advantageous embodiments of the invention are indicated in the dependent claims.

According to the invention, a boosting/blanking current is applied to a filament iteratively in a succession of steps, only for a short time interval in each step. After each application of the boosting/blanking current to the filament for such a short time interval, the tube current after this short time interval is determined, based on the stored temporal variation of the tube current, and this tube current is stored in a second memory. Therefore, the tube current after application of the boosting/blanking current for the short time interval is known.

Then, it is determined based on the stored temporal variation of the tube current, if the tube current—after the application of the boosting/blanking current for the short time interval—is less than a target value of the tube current. If so, the application of the boosting/blanking current to the filament is repeated for another short time interval, and if not, it is determined that the tube current is equal to the target value.

In this manner, an iterative approach to the target value of the tube current is performed. In each step of this iterative application of the boosting/blanking current to the filament the actual tube current may be determined based on the stored temporal variation of the tube current, i.e. based on the number of times of the short time interval. This iterative boosting/blanking process may be interrupted at any point of time, and at the point of time when the interruption occurs, the tube current is known. Then a switch-over to a new boosting/blanking time can be performed immediately, starting from the known tube current, in other words, from a known filament current, i.e. a known temperature of the filament.

According to an embodiment of the invention, the time interval is short compared to the duration of time between a starting value and the target value of the tube current. In this manner, the boosting/blanking process iteration involves a large number of iteration steps such that the boosting/blanking time is finely divided.

It is advantageous if the temporal variation of the tube current is measured with the tube voltage as a parameter, and if accordingly a plurality of temporal variations are stored in the first memory. Measurement of the temporal variation of the tube current may be performed by a calibration process for a new X-ray tube, either at the factory where the X-ray tube is manufactured, or on site where the new X-ray tube is installed. Such calibration process may also be performed in regular intervals for taking aging effects of the X-ray tube into account.

A X-ray generator for boosting/blanking the filament current of a filament of the cathode of an X-ray tube comprises a current measuring unit for measuring the tube current of the X-ray tube, a first memory for storing the temporal variation of the tube current, a filament current control unit for generating the regular and the boosting/blanking filament current, a second memory for storing the tube current after each one of a plurality of short time intervals of the boosting/blanking current, and a control unit for controlling the X-ray generator and the X-ray tube.

It is advantageous if the control unit determines the filament current generated by the filament current control unit, and/or the control unit determines the duration of the short time intervals.

Such a control unit typically comprises a processor (or microprocessor). Then the operation of the control unit may easily be determined by a storage medium on which a computer program product is stored which enables the processor to carry out the method according to the invention.

An X-ray system comprising the X-ray generator and the X-ray tube according to the invention has a reduced reaction time, since even if a boosting/blanking process is interrupted, a switch-over to a new tube current value can be performed immediately.

In Summary, for boosting/blanking the filament current of a cathode of an X-ray tube the temporal variation of the tube current of the X-ray tube is measured and stored in a first memory. Then an iterative boosting/blanking is performed wherein the boosting/blanking current is applied to the filament for a short time interval, based on the stored temporal variation of the tube current, the tube current after the short time interval is determined, and the tube current is stored in a second memory. Based on the stored temporal variation of the tube current it is determined if the tube current is less than a target value thereof, and if so, the boosting/blanking current is applied to the filament for an additional time interval, else it is determined that the tube current is equal to the target value. Therefore, the tube current after each time interval is known (may be determined from the tube current data stored in the second memory) such that the iterative boosting/blanking may be interrupted anytime.

These and other aspects of the invention will be apparent from and illustrated with reference to the embodiments described hereinafter.

DETAILED DESCRIPTION OF THE EMBODIMENTS

Figure 1:
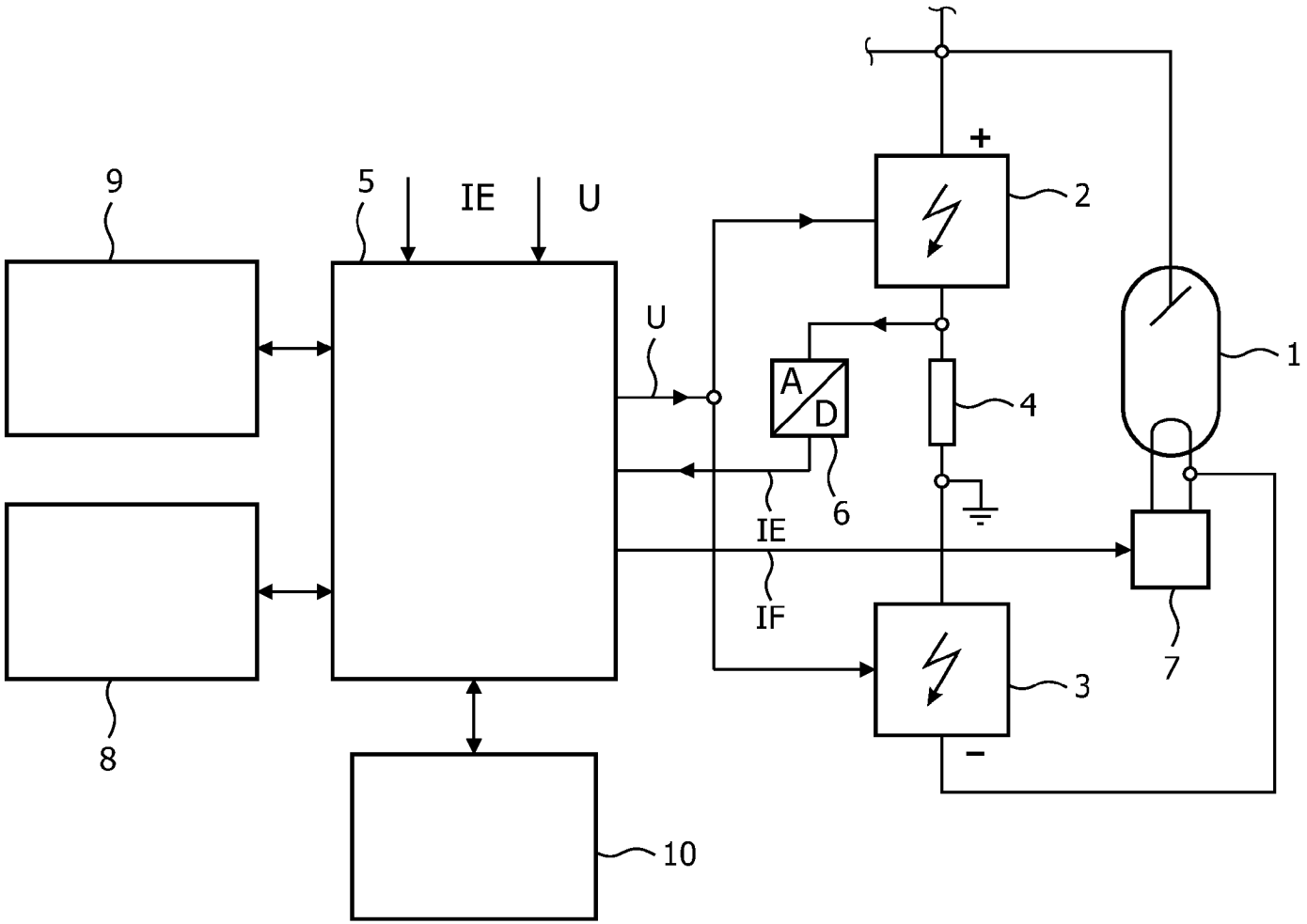
FIG. 1 shows a schematic circuit diagram of an X-ray generator and an X-ray tube according to the invention.

FIG. 1 shows a schematic circuit diagram of an embodiment of an X-ray generator for boosting/blanking the filament current of the filament of a cathode of an X-ray tube, and the X-ray tube 1.

The X-ray tube 1 is shown schematically in FIG. 1 and comprises an anode and a cathode having a filament to which a boosting/blanking current is applied. The X-ray generator shown in FIG. 1 comprises a first high voltage generating unit 2 for generating a positive high voltage for the anode of the X-ray tube 1 and a second high voltage generating unit 3 for generating a negative high voltage for the cathode of the X-ray tube 1. The X-ray tube 1 is a bipolar X-ray tube. If the X-ray tube is a unipolar X-ray tube only a single high voltage generating unit is used.

The two high voltage generating units 2, 3 are connected in series via a resistor 4, one end of which is grounded. The resistor 4 serves to measure the tube current IE flowing through the X-ray tube 1. The voltage drop across the resistor 4 is applied to an analog-to-digital converter 6 which supplies a value which is proportional to the voltage drop across the resistor 4, i.e. a value which is proportional to the tube current IE, to a control unit 5. Resistor 4 and analog-to-digital converter 6 constitute a current measuring unit.

The control unit 5 determines the filament current IF for the cathode of the X-ray tube 1 which is generated by a filament current control unit 7.

The control unit 5 cooperates with a first memory 8, in which dynamic data are stored as explained below, a second memory 10 in which values of the tube current during an iterative boosting/blanking process are stored as explained below, and a further memory 9 in which static or stationary data may be stored.

The control unit 5 combines data, in a manner described in more detail below, with values of the tube current IE and the tube voltage U given for an X-ray exposure.

Further details concerning the general operation and the functionality of the X-ray generator shown in FIG. 1 may be obtained from reference U.S. Pat. No. 5,546,441 mentioned above.

Figure 2:
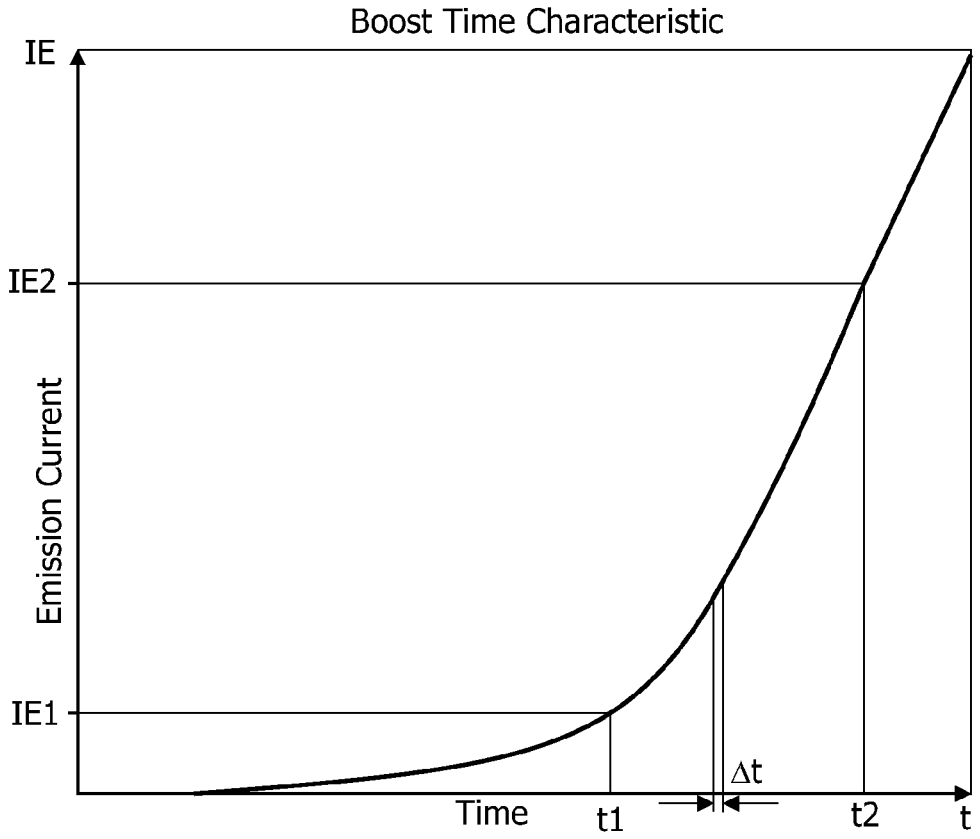
FIG. 2 shows an example for the temporal variation of the emission current of an X-ray tube, i.e. a boost time characteristic.
Figure 3:
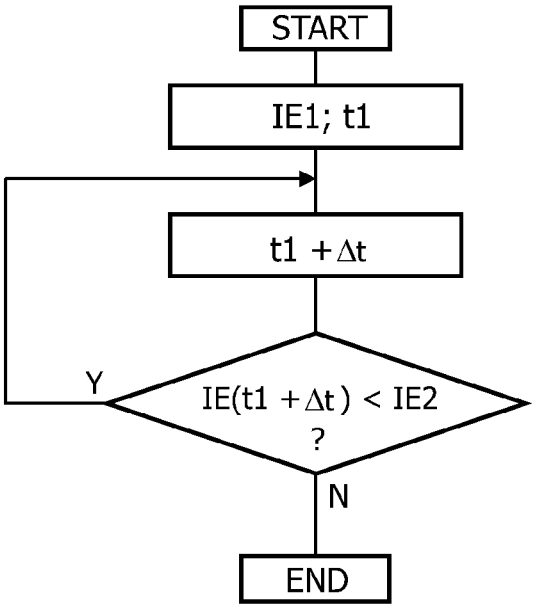
FIG. 3 shows the iterative boosting/blanking process according to the invention.

FIG. 2 shows the boost time characteristic, i.e. the temporal variation of the emission current, of a typical X-ray tube 1.

The boost time characteristic, i.e. the curve of a temporal variation of the emission current, is measured for the particular X-ray tube 1, and stored in the first memory 8, for a plurality of tube voltages U.

Shown in FIG. 2 is a case when, starting from a starting value IE1 of the emission current at a time t1, the emission current shall be boosted to a target value IE2 of the emission current at a time t2. Similar considerations apply in respect of "blanking", when the emission current IE is to be reduced from a higher value to a lower value; a blanking current has a rather small, but not negligible value or a value of zero.

In each step of the iterative boosting process according to the invention, the boosting current is applied to the filament of the cathode of the X-ray tube for a small time interval $\Delta t$ as shown in FIG. 2.

The iterative boosting process according to the invention is shown schematically in FIG. 2. At the beginning of the iterative process, a tube current (emission current) IE1 flows through the X-ray tube 1 at a point of time t1. The target value of the boosting process is the tube current IE2 at a point of time t2 shown in FIG. 2. Thus, the entire boosting process has a duration of (t2−t1).

According to the invention the boost current is applied, starting at the time t1, for the short time interval $\Delta t$. Then, it is determined (calculated), based on the temporal variation of the tube current stored in the first memory 8, if the emission current IE at the point of time ($t1+\Delta t$) is smaller than the target value IE2. If not, the boost current is again applied for an additional time interval $\Delta t$. This means, that then the boost current has been applied for a time of ($t1+2(\Delta t)$).

If boosting has been performed for a sufficient number of times $\Delta t$, the target value IE2 of the tube current is reached, and the boosting process ends.

At any time during the entire boosting process (from the starting value IE1 to the target value IE2 of the boosting current, i.e. from time t1 to time t2), the emission current IE is known, since for each step of the iterative boosting process the respective number of steps, in other words the number of time intervals $\Delta t$, is stored in the second memory 10. Therefore, the boosting process may be interrupted at any point of time between t1 and t2, and a new boosting/blanking process may be started, from the known value of the emission current obtained in the previous boosting/blanking process.

While the invention has been illustrated and described in detail in the drawings and the foregoing description, such illustration and description are to be considered illustrative or exemplary and not restrictive; the invention is not limited to the disclosed embodiments.

For example, it is possible to determine the actual filament temperature (tube current) at the beginning of the boosting/blanking process from emission current measurements, or from the simulation based on the stored temporal variation of the tube current.

Other variations to the disclosed embodiments can be understood and effected by those skilled in the art in practicing the claimed invention, from the study of the drawings, the disclosure, and dependent claims. In the claims, the word "comprising" does not exclude other elements or steps, and the indefinite article "a" or "an" does not exclude a plurality. A single process or other unit may fulfill the functions of several items recited in the claims. The mere fact that certain measures are recited in mutually different dependent claims does not indicate that a combination of these measures cannot be used to advantage. A computer program (product) may be stored/distributed on a suitable medium, such as an optical storage medium or a solid-state medium supplied together with or as part of other hardware, but may also be distributed in other forms, such as via the internet or other wired of wireless telecommunication systems. Any reference signs in the claims should not be construed as limiting the scope.

The invention claimed is:

1. A boosting/blanking method comprising the steps of:

a) measuring temporal variation of a tube current of an X-ray tube during boost;

b) storing the temporal variation in a first memory;

c) applying a boosting/blanking current to a filament of a cathode of the X-ray tube for a short time interval;

d.1) determining, based on the stored temporal variation, the tube current after the short time interval;

d.2) determining, based on the stored temporal variation, whether the tube current after the short term interval is less than a target value; and d.3) if the tube current after the short term interval is determined to be less than said target value, returning to step c);

wherein if, instead, the tube current after the short term interval is determined not to be less than said target value, returning to step c) is not performed.

2. The method of claim 1, wherein the time interval is short compared to a duration of time between a starting value and the target value.

3. The method of claim 1, wherein the temporal variation of the tube current is measured with a tube voltage as a parameter, and a plurality of temporal variations are stored in the first memory.

4. The method of claim 1, wherein, in case said applying is of a blanking current, said applying is to reduce said tube current that is to be subject to the determining of step d.1).

5. The method of claim 1, said interval being short enough that said applying is invoked multiple times to achieve said target value.

6. An X-ray generator configured for at least one of boosting and blanking a filament current of a filament of a cathode of an operable X-ray tube, said X-ray generator comprising:

a current measuring unit configured for measuring temporal variation of tube current of an X-ray tube during boost;

a first memory configured for storing the measured temporal variation;

a filament current control unit configured for generating said filament current corresponding to at least one of boosting and blanking current that causes existing tube current to respectively rise or fall;

a second memory for storing a quantifying indication of said existing tube current after each one of a plurality of time intervals of the at least one of boosting and blanking current; and a control unit configured for controlling the X-ray generator, the X-ray tube, and said storing in said second memory in an X-ray exposure mode, said X-ray exposure mode not being a preparatory mode in which a boost time is computed for later use in an X-ray exposure mode, said control unit being further configured for, responsive to an interruption of correspondingly said boosting or said blanking, switching targeting over to a new tube current value and using an indication from among the stored indications to adjust a re-invocation of said generating so as to achieve said value.

7. The X-ray generator of claim 6, wherein the control unit determines said filament current.

8. An X-ray system comprising the X-ray generator and the X-ray tube of claim 6.

9. The X-ray generator of claim 6, said tube current of an X-ray tube being tube current of said operable X-ray tube.

10. The X-ray generator of claim 9, wherein said control unit determines a duration of said time intervals.

11. The X-ray generator of claim 6, wherein the time interval is short compared to a duration of time of correspondingly the boosting or blanking.

12. The X-ray generator of claim 6, said interval being short enough that the generated current correspondingly rises or falls multiple times to achieve a target value.

13. The X-ray generator of claim 6, said filament current control unit being further configured for iteratively applying said filament current so as to progressively increment, or decrement, tube current of said operable X-ray tube, the iterative applying comprising applying and applying again.

14. The X-ray generator of claim 6, configured for said generating of a blanking current so as to cause said fall.

15. The X-ray generator of claim 6, said controller being further configured for fetching, from said second memory, the indication to be used in said using.

16. The X-ray generator of claim 6, the causing to respectively rise or fall causing corresponding rise or fall toward a targeted tube current from which the switching over is to occur.

17. A non-transitory computer readable medium embodying a computer program for at least one of boosting, and blanking, a filament current of a filament of a cathode of an operable X-ray tube, said program having instructions executable by a processor to carry out a plurality of acts, among said plurality there being the acts of:

a) measuring temporal variation of tube current of an X-ray tube during boost;

b) storing the temporal variation in a first memory, thereby creating stored temporal variation;

c) applying respectively a boosting, or blanking, current to the filament of said cathode for a short time interval;

d.1) determining, for tube current that exists after the interval for said operable X-ray tube, a quantifying indication of the existing tube current; and storing said indication in a second memory;

d.2) determining, based on said stored temporal variation, whether said existing tube current is less than a target value of said existing tube current;

d.3) if it is determined in step d.2) that said existing tube current is less than said target value, returning to step c); and d.4) if it is, instead, determined in step d.2) that said existing tube current is not less than said target value, not returning to step c).

18. An X-ray generator configured for at least one of boosting and blanking a filament current of a filament of a cathode of an operable X-ray tube, said X-ray generator comprising:

a current measuring unit configured for measuring tube current of an X-ray tube during boost;

a first memory configured for storing temporal variation of said tube current;

a filament current control unit configured for generating said filament current corresponding to at least one of boosting and blanking current that causes existing tube current to respectively rise or fall;

a second memory for storing a quantifying indication of said existing tube current after each one of a plurality of time intervals of the at least one of boosting and blanking current; and a control unit configured for controlling the X-ray generator, the X-ray tube, and said storing in said second memory in an X-ray exposure mode, said X-ray exposure mode not being a preparatory mode in which a boost time is computed for later use in an X-ray exposure mode, said control unit being further configured for comparing a stored indication to a targeted tube current, and for, responsive to an interruption dynamically switching targeting to a new tube current, using an indication from among the quantifying indications to shorten a reaction time in re-invoking said generating toward meeting the targeted new tube current.

19. The X-ray generator of claim 18, said controller being further configured for fetching, from said second memory, the indication to be used in said using.

20. The X-ray generator of claim 18, the causing to respectively rise or fall causing corresponding rise or fall toward said targeted tube current.

21. The X-ray generator of claim 18, configured for said generating of a blanking current so as to cause said fall.

* * * * *